United States Patent [19]

Goncalves

[11] 4,185,747

[45] Jan. 29, 1980

[54] BOTTLE STOPPER WITH INVIOLABILITY DEVICE

[75] Inventor: Antonin L. Goncalves, Groslay, France

[73] Assignee: L'Oreal, Paris, France

[21] Appl. No.: 777,142

[22] Filed: Mar. 14, 1977

[30] Foreign Application Priority Data

Apr. 6, 1976 [FR] France ..... 76 09956

[51] Int. Cl.[2] ..... B65D 41/32

[52] U.S. Cl. ..... 215/253; 215/250

[58] Field of Search ..... 215/250, 253, 355

[56] References Cited

U.S. PATENT DOCUMENTS

| | | | |
|---|---|---|---|
| 726,039 | 4/1903 | Fitzsimmons | 215/253 |
| 1,393,925 | 10/1921 | Townsend | 215/355 |
| 3,251,499 | 5/1966 | Rausing | 215/355 |
| 3,348,719 | 10/1967 | Rausing | 215/253 |
| 3,780,897 | 12/1973 | Wassilieff | 215/253 |
| 3,902,619 | 9/1975 | Gouget | 215/253 |

FOREIGN PATENT DOCUMENTS

| | | | |
|---|---|---|---|
| 253375 | 4/1967 | Austria | 215/355 |
| 1432172 | 7/1961 | Fed. Rep. of Germany | 215/253 |
| 1182544 | 11/1964 | Fed. Rep. of Germany | 215/355 |
| 1040076 | 10/1953 | France | 215/355 |
| 1564034 | 3/1968 | France | 215/253 |
| 1197189 | 7/1970 | United Kingdom | 215/253 |

*Primary Examiner*—Ro E. Hart

*Attorney, Agent, or Firm*—Brisebois & Kruger

[57] ABSTRACT

Bottle stopper is provided with rupturable wall section which is placed under stress when the stopper is removed from the bottle but not when the stopper is inserted in the bottle.

10 Claims, 3 Drawing Figures

BOTTLE STOPPER WITH INVIOLABILITY DEVICE

SUMMARY OF THE INVENTION

This invention relates to a stopper for closing bottles or other containers adapted to hold liquid or solid products.

It is well known that it may be advantageous to provide bottle stoppers with an inviolability or guaranty device for preventing the stopper from being removed in order to withdraw at least part of the content and then replaced in position on the neck of the container.

Such an inviolability device, if it has not been removed and is still intact, then makes it possible for the user to be certain of the fact that the contents of the bottle are those which have been orginally placed therein by the manufacturer. Likewise these inviolability devices may be provided for safety reasons. In this case, for example, in the pharmaceutical or cosmetic industry, when liquid products are sold which must be stored sealed from the air and which, after first contact with the outer atmosphere after a first opening of the bottle, are capable of engendering gases, there is an imperative necessity in order to avoid any risk of explosion to provide stoppers which, by reason of their inviolability devices, cannot be replaced to form a seal on the bottle by the first user when first use has not consumed the entire contents of the bottle.

These inviolability devices are most frequently made in the form of a weakened wall zone which the user breaks or tears manually to remove the stopper and open the container. However, with certain stoppers actually in use there is a by no means negligible risk that the inviolability device may break by reason of its fragility during the operation of mounting the stopper in the neck of the container. If the inviolability device is broken, the stopper can no longer serve its sealing function and it is then necessary to remove the part of the stopper which remains in the neck of the container and reseal it by inserting a new stopper in the neck. This has the effect of increasing the cost of the bottling operation. In order to avoid such a risk it is obviously possible to reinforce the safety device, but in this case the consumer then may not, without the aid of a tool, be able to tear the inviolability device to open the container.

It is the object of the present invention to overcome the above disadvantage and, for this purpose, it is proposed to make a bottle stopper the inviolability device of which may be manually torn by the user to open the container without said inviolability device being capable of being torn or damaged at the moment at which the stopper is forced into the neck of the container during the initial closing operation by the manufacturer.

It is accordingly an object of the present invention to provide a new article of manufacture which consists of a stopper for closing the neck of a container, the part of said stopper which remains outside the container being provided with a prehensile device on which the user acts to rupture an inviolability device associated with the stopper. The stopper comprises a skirt which is connected near its bottom edge by a rupturable peripheral zone of the wall forming the inviolability device, to a retaining sleeve adapted to be positioned inside the container, and is characterized by the fact that said skirt is provided with a peripheral continuous or discontinuous protective rib positioned opposite the edge by means of which the retaining sleeve is connected to the skirt so that, at the moment of depression of the stopper into the neck of the container, the protective rib bears on the retaining sleeve to transmit to the sleeve the force of insertion without the least tension being exerted on the rupturable wall.

In a preferred embodiment the skirt of the stopper is generally cylindrical in shape and has an axis which coincides with that of the retaining sleeve, the external diameter of said skirt being less than the internal diameter of the retaining sleeve; and the peripheral protective rib is discontinuous and consists of a plurality of pins preferably positioned regularly about the periphery of the edge of the skirt which is situated on the side of the retaining sleeve. The skirt is connected by its outer edge, which is not connected to the retaining sleeve, to a top positioned outside the neck. The top of the plug is in the form of a flat disc positioned perpendicularly to the axis of the skirt, said disc projecting radially with respect to the skirt and bearing, when the plug closes the neck, on the edge of the latter. The disc which constitutes the top of the plug has an extension in the form of a prehensile tongue on which the user pulls to rupture the inviolability device. The retaining sleeve comprises a free end zone which is frusto-conical in shape, the section of which narrows on the side remote from the skirt. The retaining sleeve comprises in relief on its external surface at least one peripheral mounting rib adapted to snap fit into a groove provided for this purpose on the inner wall of the neck. The plug is made in one piece by molding it from a flexible plastic material, such as polyethylene for example. One of the essential characteristics of such a plug is that the step of closing the containers during manufacture takes place without risk of damaging or rupture of the peripheral zone of rupturable wall which constitutes the inviolability device. In effect, during insertion of the plug into the neck of the container, the protective rib with which the skirt is equipped bears against the retaining sleeve so that this peripheral zone of the rupturable wall is not subjected to any mechanical force. The limitation of the depression of the stopper occurs when the flat top of the stopper comes to bear against the upper edge of the bottle neck.

On the contrary, when the user wants to open the container, it suffices that he exert a simple traction on the stopper to lift it from the container by tearing the inviolability device which is no longer protected by the protective rib. After removing the stopper the, retaining sleeve remains inside the neck of the container and the contents of the container flow therethrough. In order to dispense the product stored in the container the user may if he so desires, place a dispensing spout on the neck. It is clear that, after opening, the user can no longer seal the container by putting back the torn part of the stopper, to wit the skirt and the disc which constitutes its top, because the skirt and its rib have an outer diameter smaller than the inner diameter of the neck.

In order to better understand the invention a preferred embodiment thereof will now be described, purely by way of illustration and example, with reference to the accompanying drawings, in which.

Figure 1:
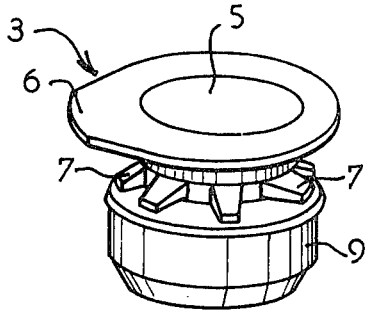
FIG. 1 is a perspective view showing a stopper according to the invention.
Figure 2:
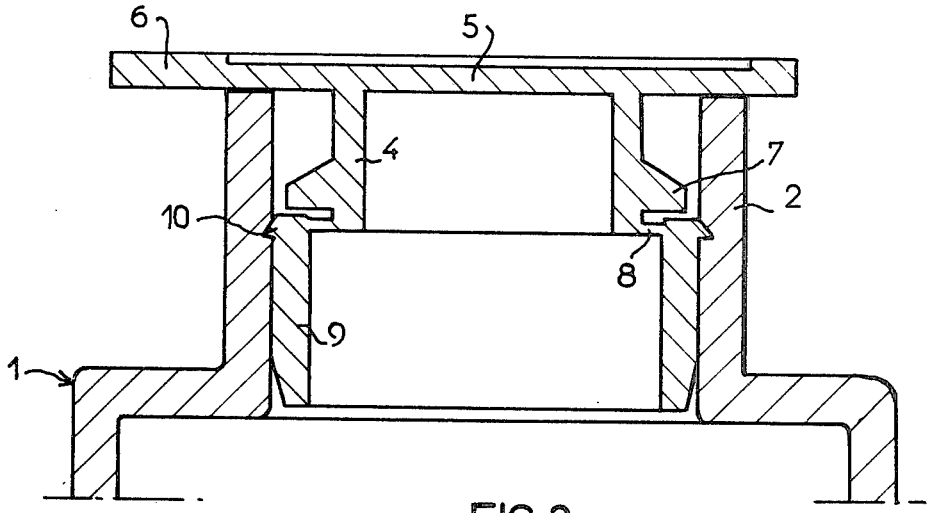
FIG. 2 is an axial sectional view showing the upper part of a container in the neck of which the stopper of FIG. 1 is mounted.

Referring now to the drawings, it will be seen that reference numeral 1 indicates a bottle of plastic material. This bottle comprises a neck 2 closed by a stopper 3 according to the invention.

The stopper 3 comprises a cylindrical skirt 4 which is connected to a top 5. The skirt 4 is adapted to be received inside the neck 2. It has an external diameter clearly less than the internal diameter of the neck 2. The top of the stopper is in the form of a disc 5 positioned perpendicularly to the axis of the skirt 4. This disc projects radially with respect to the skirt 4 and bears, when the stopper closes the neck 2, on the edge of the latter. A prehensile tongue 6 having a rounded form extends radially from the disc 5.

On the outer face of the cylindrical skirt 4, and near the edge thereof which is remote from that at which it is connected to the disc 5, pins 7 are formed in relief and used, as will be hereinafter explained in a more detailed manner, to protect the inviolability device with which the stopper 3 is equipped.

These protective pins which are 8 in number are positioned preferably in a regular manner, that is to say substantially at 45° angles. They constitute a discontinuous rib.

The edge of the end of the cylindrical skirt 4 is connected to a retaining sleeve 9 by an annular rupturable wall zone 8 which constitutes the inviolability device. This annular zone 8 has a wall thickness which is much thinner than that of the retaining sleeve 9 or the skirt 4. It may thus be easily ruptured or torn by subjecting it to weak traction when the skirt 4 is lifted relative to the sleeve 9.

The retaining sleeve 9 is generally cylindrical in shape and positioned axially of the skirt 4. The geometry of this sleeve 9 is such that it may be adjusted to remain inside the neck 2. The sleeve 9 is retained by snap fitting a peripheral sealing rib 10 positioned in relief on its outer wall in a groove formed for this purpose in the inner wall of the neck 2. The retaining sleeve is attached irreversibly inside the neck. It follows that any step which removes the stopper 3 from the neck 2 cannot be carried out without injury to the inviolability device 8. In effect, when the user, by acting on the prehensile tongue 6, pulls the stopper 3 from the neck 2, he tears the weakened wall zone 8 long before the release of the retaining sleeve is possible.

In order to facilitate penetration of the retaining sleeve 9 into the neck 2 this sleeve comprises a frutoconical free end zone, the section of which narrows in the direction away from the skirt 4. The protective pin 7 extends into the annular space between the wall of the neck 2 and the cylindrical skirt 4 of the stopper beyond the end of the retaining sleeve 9 to which the inviolability device 8 is attached. The stopper which has just been described is attached by simply forcing it into the neck 2, the mounting ring 10 entering into the corresponding groove in the inner wall of the neck 2. In this position the plate 5 which constitutes the top of the stopper 3 bears substantially against the edge of the neck 2. In the course of the depression of the stopper 3 in the neck of the container, the protective pins 7 come, as a result of the pressure exerted, to bear against the retaining sleeve, due to a slight deformation of the zone of the rupturable wall. Pressure exerted on the top 5 is thus directly transmitted to the retaining sleeve 9 without passing through the inviolability device 8 which is subjected to practically no mechanical force. It follows that the inviolability device 8, despite its fragility, is not capable of tearing or being damaged when the stopper is being positioned on the container 1.

Figure 3:
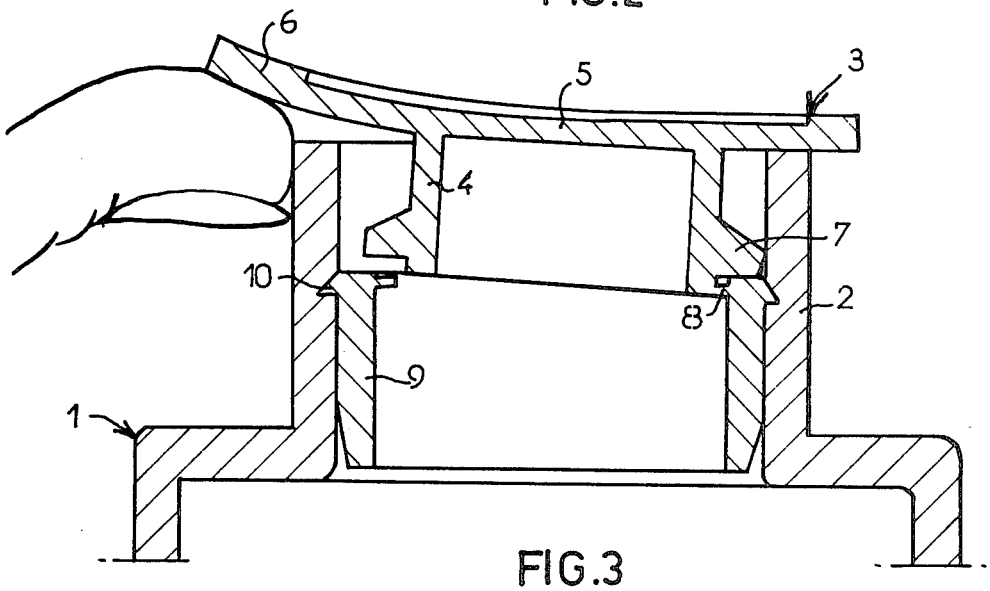
FIG. 3 is an axial sectional view showing the upper part of the container of FIG. 2 at the moment at which it is opened by tearing the zone of the rupturable wall constituting the inviolability device.

In order to open the container 1 which is closed by such a stopper, the user manually lifts the stopper by acting on the prehensile tongue 6, the disc 5, and its skirt 4, to swing them transversely with respect to the neck 2 as is shown on FIG. 3. This swinging step is accompanied, first by a deformation of the annular zone of the rupturable wall 8, and then by the pressure of the protective pins 7 on the sleeve 9 which pins are diametrically opposed to the prehensile tongue 6. The protective pin or pins which bear on the retaining sleeve 9 during swinging constitute the fulcrum of the lever formed by the disc 5 and its extension 6. Continuing this manoeuver, the user may then easily tear the weakened wall zone 8 and thus detach the removable part of the stopper which consists of the top 5 and its associated skirt 4 from the part which remains in the bottle, which consists of the retaining sleeve 9. The user may then proceed to the distribution of the product contained in the bottle, which distribution may be carried out, if desired, by means of a dispensing head, the attaching skirt of which may, without any difficulty, be seated in the neck, since the end zone of the latter is no longer occupied by the skirt.

It is clear that the user cannot, by means of the torn part 4, 5 of the stopper 3, reclose the container 1 in a fluid-tight manner.

It should be emphasized that the inviolability stopper according to the invention is inexpensive since it may be manufactured in a single piece by molding it from a flexible plastic material such as polyethylene, for example.

It will of course be appreciated that the embodiment which has just been described has been given purely by way of illustration and example and may be modified as to detail without thereby departing from the basic principles of the invention.

What is claimed is:

1. In a stopper for closing the neck of a container, said stopper having a part adapted to be situated outside the container and provided with a prehensile device on which the user may pull to rupture an inviolability device associated with the stopper, said stopper further comprising a skirt which is connected near its lower edge to a peripheral frangible wall forming said inviolability device and by said frangible wall to a retaining sleeve adapted to be located inside the container, the improvement according to which said skirt is provided with a peripheral protective rib positioned adjacent the edge by which the retaining sleeve is connected to said skirt, so that during the insertion of the stopper into the neck of the container the protective rib bears on the retaining sleeve and in which peripheral protective rib is discontinuous and comprises a plurality of pins generally regularly positioned about the periphery of the skirt adjacent the retaining sleeve.

2. In a stopper for closing the neck of a container, said stopper having a part adapted to be situated outside the container and provided with a prehensile device on which the user may pull to rupture an inviolability device associated with the stopper, said stopper further comprising a skirt which is connected near its lower edge to a peripheral frangible wall forming said inviolability device and by said frangible wall to a retaining sleeve adapted to be located inside the container, the improvement according to which said skirt is provided with a peripheral protective rib positioned adjacent the edge by which the retaining sleeve is connected to said skirt, said rib comprising means for directly transmitting to the sleeve, pressure exerted on said skirt during insertion of the stopper into the neck of the container, without subjecting the frangible wall to said pressure, so that damage to said frangible wall is avoided during insertion of the stopper.

3. Device as claimed in claim 2 in which the skirt is generally cylindrical in shape and has an axis which coincides with that of the retaining sleeve, the external diameter of said skirt being less than the internal diameter of the retaining sleeve.

4. Stopper as claimed in claim 2 in which the skirt is connected by its edge which is not connected to the retaining sleeve to a top positioned outside the neck.

5. Stopper as claimed in claim 4 characterized by the fact that the top of the stopper is in the form of a flat plate positioned perpendicularly to the axis of the skirt, said plate projecting radially with respect to said skirt and bearing on the edge of the neck when the stopper closes the neck.

6. Stopper as claimed in claim 4 in which the plate which constitutes the top of the stopper has an extension in the form of a prehensile tongue on which the user may act to rupture the inviolability device.

7. Stopper as claimed in claim 2 in which the retaining sleeve comprises a free end zone which is frustoconical in shape, the section of which narrows away from the skirt.

8. Stopper as claimed in claim 2 in which the retaining sleeve comprises in relief on its external face at least one peripheral mounting rib adapted to snap into a groove provided for this purpose in the inner wall of the neck of the container.

9. Stopper as claimed in claim 2 which is molded in a single piece from a flexible plastic material such as polyethylene.

10. A stopper according to claim 2 wherein said frangible wall extends radially between said skirt and said sleeve.

* * * * *